US008745926B2

(12) United States Patent
De Domenico

(10) Patent No.: US 8,745,926 B2
(45) Date of Patent: Jun. 10, 2014

(54) FRAMELESS ACCESS PANEL WITH LATCH MEMBER

(76) Inventor: Fabio Giovanni De Domenico, Maple (CA)

( * ) Notice: Subject to any disclaimer, the term of this patent is extended or adjusted under 35 U.S.C. 154(b) by 0 days.

(21) Appl. No.: 13/214,563

(22) Filed: Aug. 22, 2011

(65) Prior Publication Data

US 2012/0159863 A1 Jun. 28, 2012

(30) Foreign Application Priority Data

Jan. 6, 2011 (CA) ..... 2726951
Jun. 15, 2011 (CA) ..... 2743342
Jul. 25, 2011 (CA) ..... 2747254

(51) Int. Cl.
*E05C 21/02* (2006.01)

(52) U.S. Cl.
USPC ..... 49/465

(58) Field of Classification Search
USPC ..... 49/463, 465, 466
See application file for complete search history.

(56) References Cited

U.S. PATENT DOCUMENTS 1,693,190 A 11/1928 Benedetti
1,876,115 A * 9/1932 Way ..... 70/139
2,009,132 A 7/1935 Gehris
2,100,928 A * 11/1937 Way ..... 16/358
2,525,479 A 10/1950 Cunningham
2,850,774 A * 9/1958 Carnick ..... 49/465
2,860,904 A 11/1958 Barry et al.
2,900,204 A 8/1959 Pelcin
3,179,455 A 4/1965 Blair
3,302,964 A 2/1967 Barry
3,317,674 A 5/1967 Nawman
3,402,958 A 9/1968 Barry
3,491,486 A 1/1970 Caruth
3,571,977 A * 3/1971 Abeel ..... 49/379
3,704,563 A 12/1972 Waller
3,792,551 A * 2/1974 Hallas ..... 49/463
3,975,870 A * 8/1976 Naka ..... 52/20
4,048,766 A * 9/1977 Dantzer et al. ..... 52/19
4,098,025 A * 7/1978 Stock et al. ..... 49/388
4,106,236 A * 8/1978 Oliphant ..... 49/141
4,113,303 A * 9/1978 Yench ..... 296/217
4,143,733 A * 3/1979 Morello et al. ..... 180/69.24

(Continued)

FOREIGN PATENT DOCUMENTS

AT 407417 3/2001
CN 201080691 7/2008

(Continued)

OTHER PUBLICATIONS

Brochure, Series APU SpringFit Access Panels, Watts Regulator Company, 2006.

*Primary Examiner* — Jerry Redman

(57) ABSTRACT

A frameless access panel comprising a panel member having an inner surface and an outer surface, a mounting member mounted to the inner surface and comprising at least one fixed tab extending outwardly therefrom, the fixed tab being spaced from a first edge of the panel member, and at least one cam latch member comprising a cam latch rotatable around an axis spaced from a second edge of the panel member, which is opposite the first edge. The cam latch is rotatable between a first position and a second position, where the second position is spaced further from the second edge than the first position. The frameless access panel is generally non-combustible.

16 Claims, 16 Drawing Sheets

(56) References Cited

U.S. PATENT DOCUMENTS

| | | | | | |
|---|---|---|---|---|---|
| 4,257,193 | A | | 3/1981 | Williams | |
| 4,391,065 | A | * | 7/1983 | Rice | 49/465 |
| 4,484,220 | A | * | 11/1984 | Beetner | 348/730 |
| 4,635,397 | A | | 1/1987 | Wooten | |
| 4,679,365 | A | | 7/1987 | Herring | |
| 4,910,937 | A | | 3/1990 | Sperling | |
| 4,970,836 | A | | 11/1990 | Brown | |
| 5,030,795 | A | * | 7/1991 | Domigan | 174/482 |
| 5,067,278 | A | * | 11/1991 | Lyons | 49/463 |
| 5,255,479 | A | | 10/1993 | Sheperd | |
| 5,315,798 | A | * | 5/1994 | Zarwell | 52/202 |
| 5,326,140 | A | | 7/1994 | Randall | |
| 5,327,682 | A | * | 7/1994 | Holtz | 49/463 |
| 5,361,541 | A | * | 11/1994 | Szyjkowski | 49/465 |
| 5,482,232 | A | | 1/1996 | Wynn et al. | |
| 5,653,061 | A | * | 8/1997 | Hiner | 49/463 |
| 5,669,190 | A | | 9/1997 | Szyjkowski | |
| 5,765,312 | A | | 6/1998 | Szyjkowski | |
| 5,832,671 | A | * | 11/1998 | White | 49/465 |
| 5,878,608 | A | | 3/1999 | Alyanakian | |
| 6,334,282 | B1 | * | 1/2002 | Wood | 52/202 |
| 6,363,670 | B1 | | 4/2002 | Dewitt | |
| 6,367,200 | B1 | * | 4/2002 | LaConte | 49/465 |
| 6,546,673 | B2 | * | 4/2003 | Aquino | 49/465 |
| 6,557,956 | B2 | | 5/2003 | Hightower | |
| 6,618,996 | B1 | | 9/2003 | Szyjkowski | |
| 6,830,274 | B2 | * | 12/2004 | Burkhardt et al. | 296/1.06 |
| 6,848,226 | B1 | | 2/2005 | Boyd et al. | |
| 6,931,794 | B1 | | 8/2005 | Burgess | |
| 7,234,738 | B2 | * | 6/2007 | Tsao et al. | 292/242 |
| 7,305,800 | B1 | * | 12/2007 | Calfee | 52/203 |
| 7,469,502 | B1 | * | 12/2008 | Steel | 49/465 |
| 7,614,187 | B1 | | 11/2009 | Forbes | |
| D611,170 | S | | 3/2010 | Hiner | |
| 2002/0100218 | A1 | * | 8/2002 | Aquino | 49/463 |
| 2011/0219695 | A1 | * | 9/2011 | Ivasiv et al. | 49/394 |

FOREIGN PATENT DOCUMENTS

| | | |
|---|---|---|
| CN | 101440655 | 5/2009 |
| DE | 3736060 | 12/1988 |
| DE | 20210036 | 10/2002 |
| DE | 20313495 | 12/2003 |
| DE | 200311070 | 1/2004 |
| DE | 10331981 | 2/2005 |
| GB | 2199362 | 7/1988 |
| GB | 2393975 | 12/2005 |
| GB | 2410544 | 3/2008 |
| SE | 4652268 | 3/1990 |
| WO | 2009006970 | 1/2009 |

* cited by examiner

FRAMELESS ACCESS PANEL WITH LATCH MEMBER

CROSS-REFERENCE TO RELATED APPLICATION

This application claims the benefit of U.S. Provisional Application No. 61/426,859 filed on Dec. 23, 2010, the content of which is incorporated herein by reference in its entirety.

FIELD OF THE INVENTION

The present invention relates generally to access panels and in particular, to a frameless access panel.

BACKGROUND OF THE INVENTION

Access panels are used in the housing and construction industries for providing removable covers of utilities located behind structural surfaces, such as walls and ceilings. The utility may be a plumbing fixture, such as for example a valve on a water line or a meter on a gas line, or an electrical fixture, such as for example an electrical switch or circuit breaker. The access panel is removable for providing access to the utility.

Frameless access panels are designed to grip an inside surface of an opening within a wall or ceiling, without requiring a separate frame to be mounted within the opening. Several frameless access panels have been previously described. For example, U.S. Pat. No. 5,669,190 to Szyjkowski is directed to a detachable panel or grill for covering an opening in paneling of a wall or ceiling or in an appliance.

U.S. Pat. No. 5,765,312 to Szyjkowski is directed to an access panel for installation over an opening in paneling of a wall or ceiling.

U.S. Pat. No. 6,618,996 to Szyjkowski is directed to an access panel for covering an aperture in a structure.

U.S. Pat. No. 6,931,794 to Burgess is directed to a framing device or support member for framing a fitting.

U.S. Design Pat. No. D611,170 to Hiner is directed to a design of an access panel.

Swedish Patent No. 465,226 to Wahlberg is directed to an inspection hatch comprising a cover panel intended, when positioned, to cover an opening in a so-called pipe shaft.

Improvements of frameless access panels are generally desired. It is therefore an object of the present invention to provide a novel frameless access panel.

SUMMARY OF THE INVENTION

Accordingly, in one aspect there is provided a frameless access panel comprising:

a panel member having an inner surface and an outer surface;

a mounting member mounted to the inner surface and comprising at least one fixed tab extending outwardly therefrom, the fixed tab being spaced from a first edge of the panel member; and at least one cam latch member comprising a cam latch rotatable around an axis spaced from a second edge of the panel member, the second edge being opposite the first edge, the cam latch being rotatable between a first position and a second position, the second position being spaced further from the second edge than the first position;

the frameless access panel being generally non-combustible.

BRIEF DESCRIPTION OF THE DRAWINGS

Embodiments will now be described more fully with reference to the accompanying drawings in which.

DETAILED DESCRIPTION OF THE EMBODIMENTS

Figure 1:
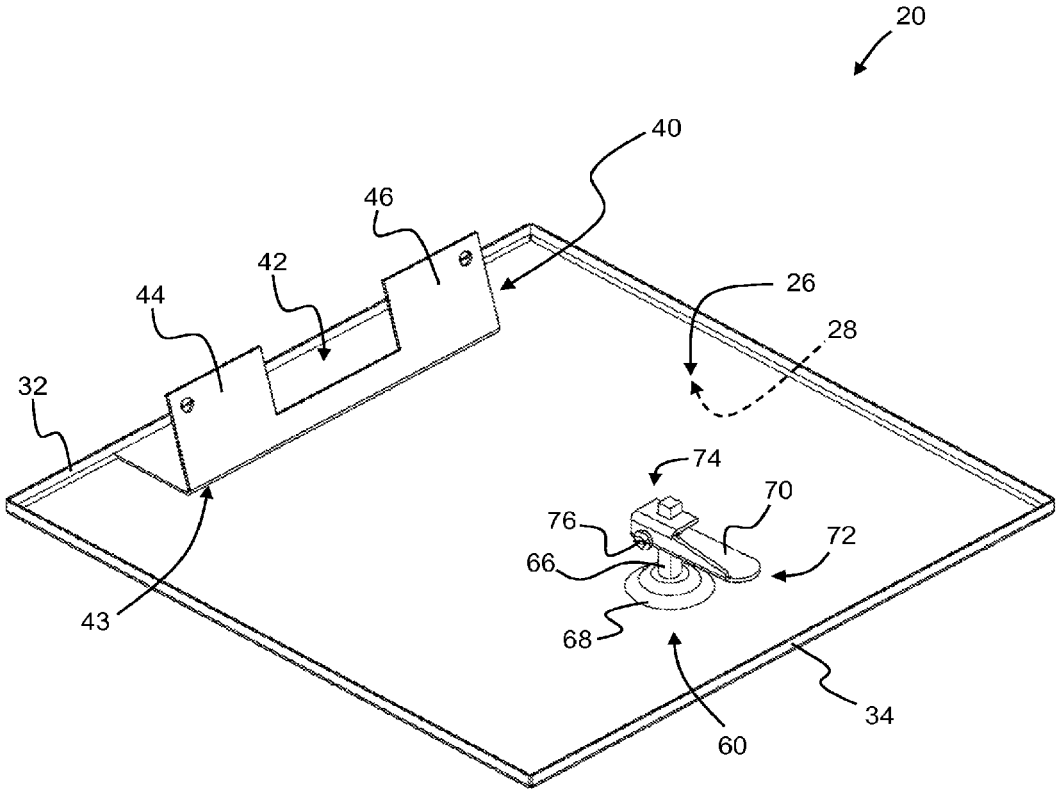
FIG. 1 is a perspective view of a frameless access panel.
Figure 2:
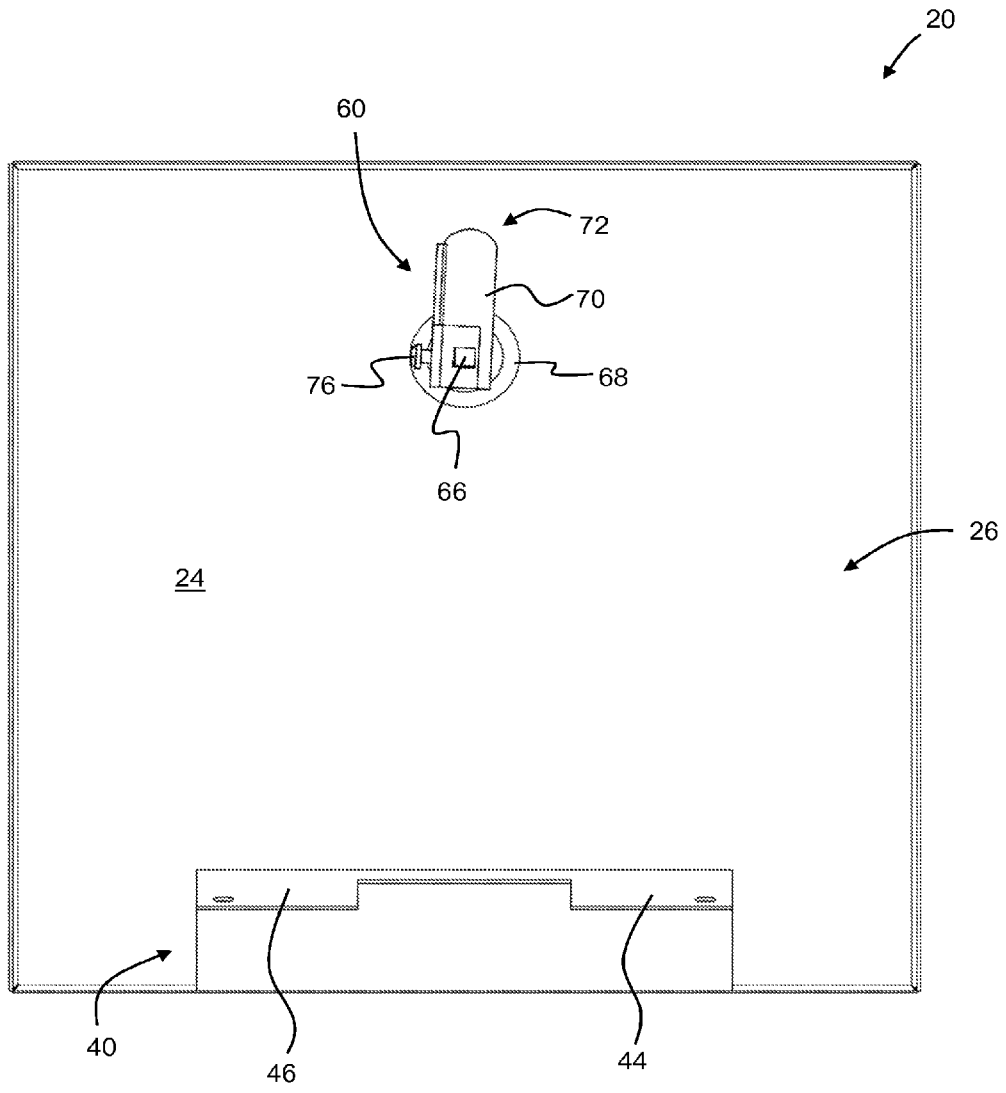
FIG. 2 is a plan view of the frameless access panel of FIG. 1, showing an inner side.
Figure 3:
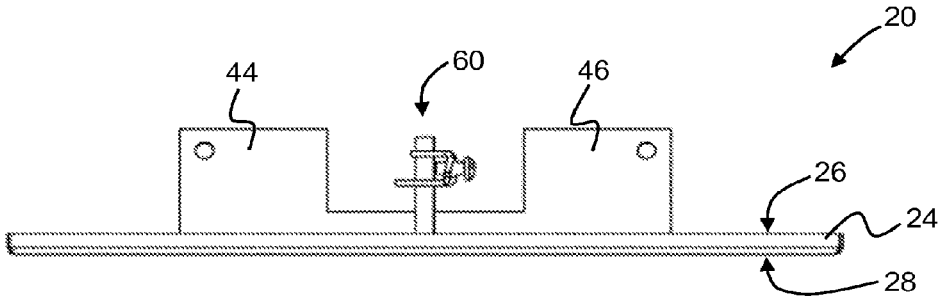
FIG. 3 is a front elevation view of the frameless access panel of FIG. 1.
Figure 4:
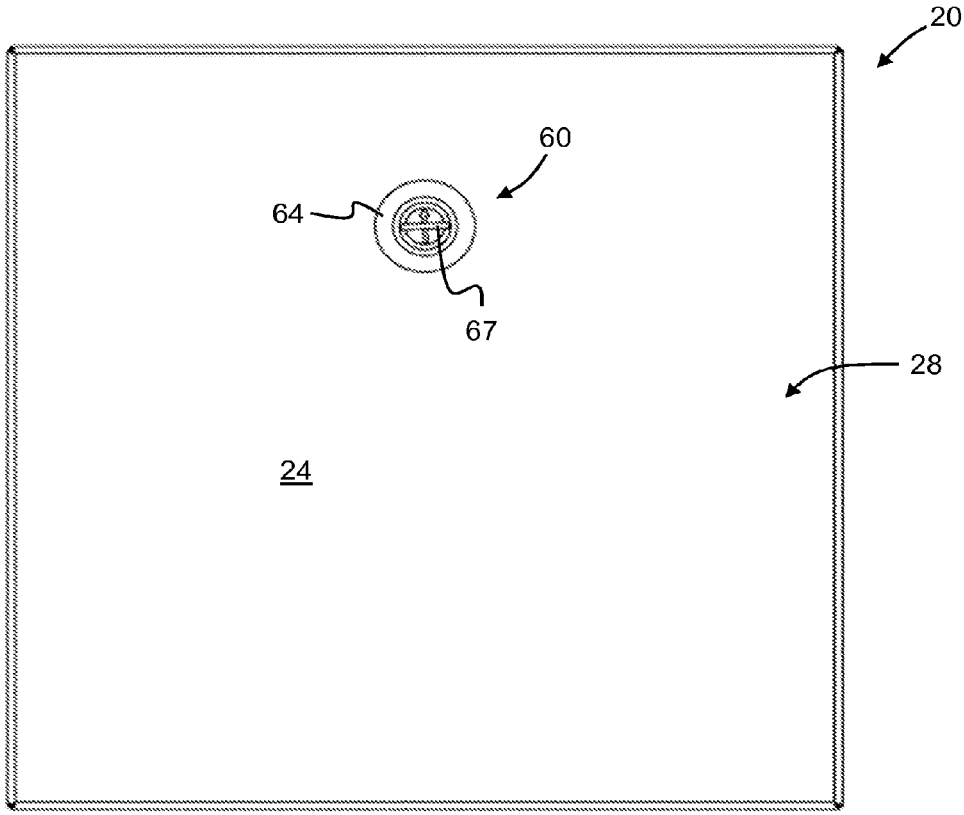
FIG. 4 is another plan view of the frameless access panel of FIG. 1, showing an outer side.
Figure 5:
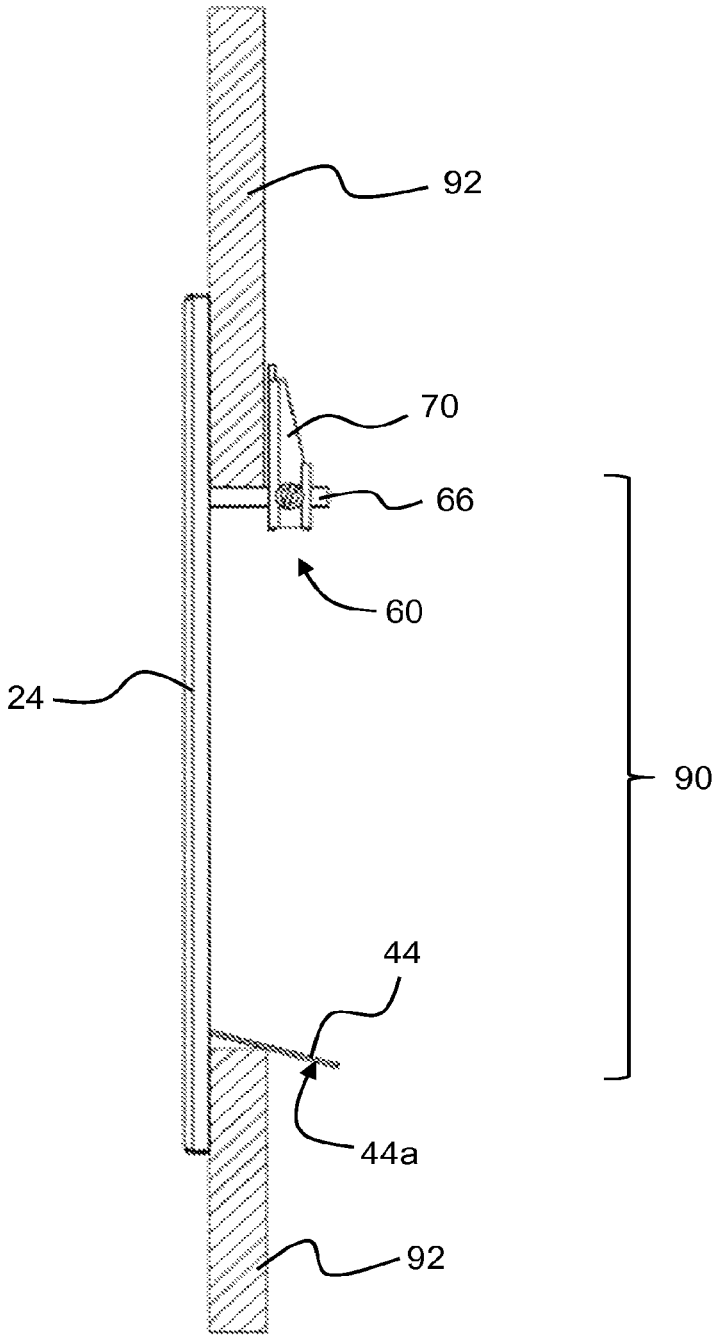
FIG. 5 is a side view of the frameless access panel of FIG. 1 installed into a wall opening during use.
Figure 6:
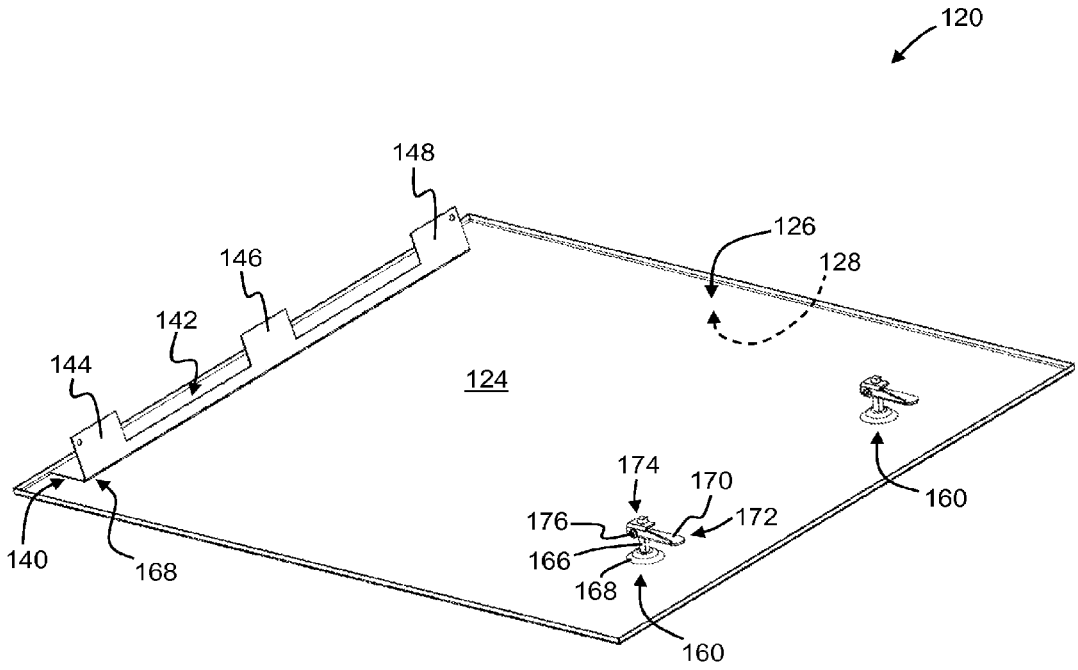
FIG. 6 is a perspective view of another embodiment of a frameless access panel.
Figure 7:
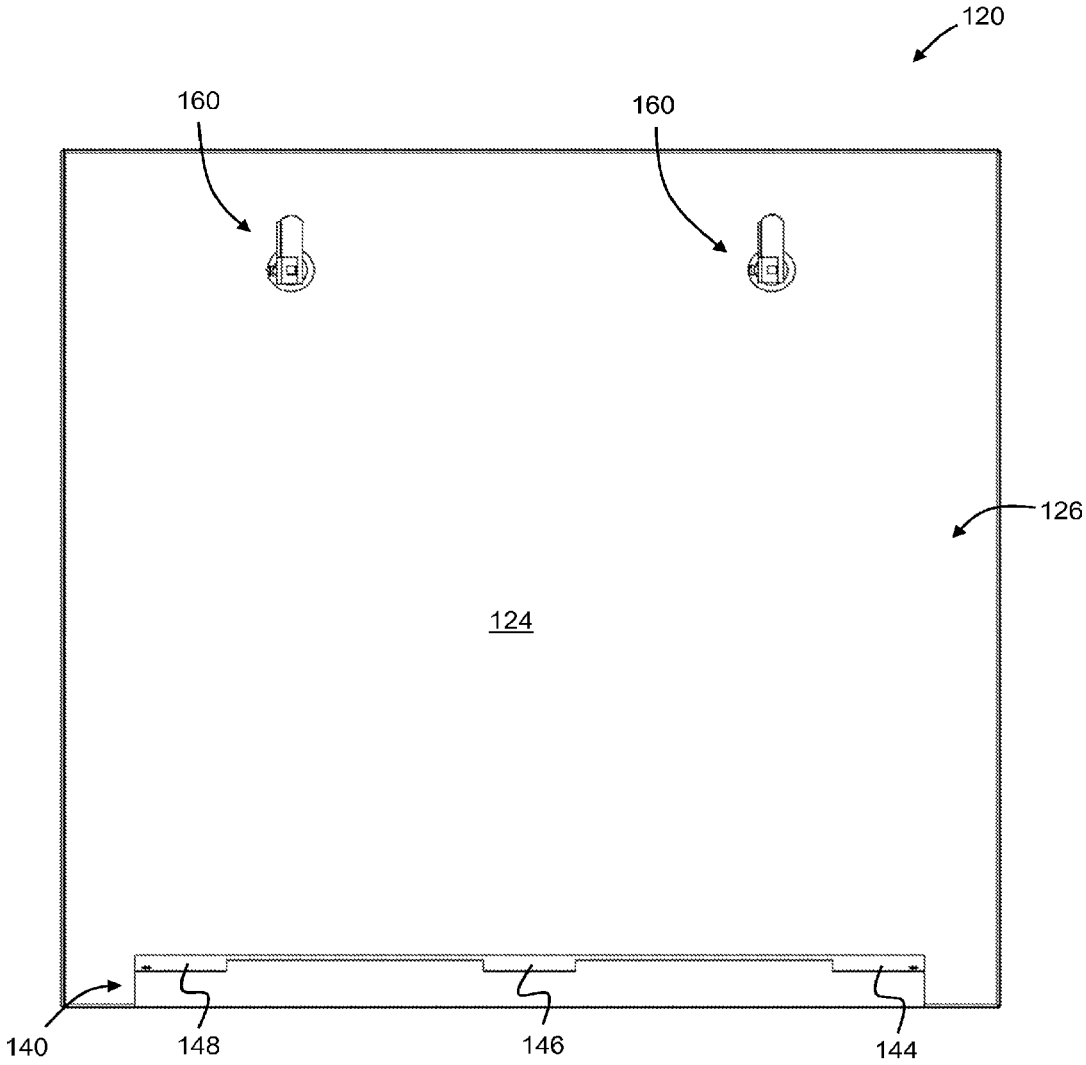
FIG. 7 is a plan view of the frameless access panel of FIG. 6, showing an inner side.
Figure 8:
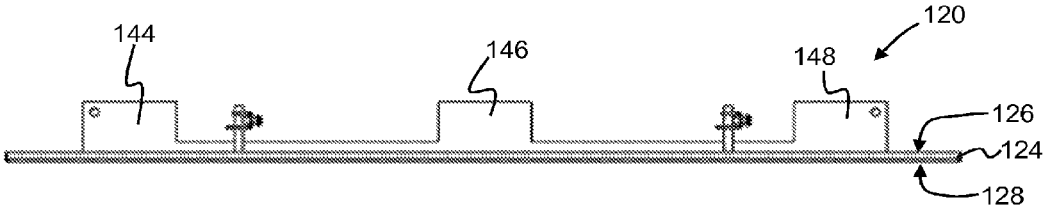
FIG. 8 is a front elevation view of the frameless access panel of FIG. 6.
Figure 9:
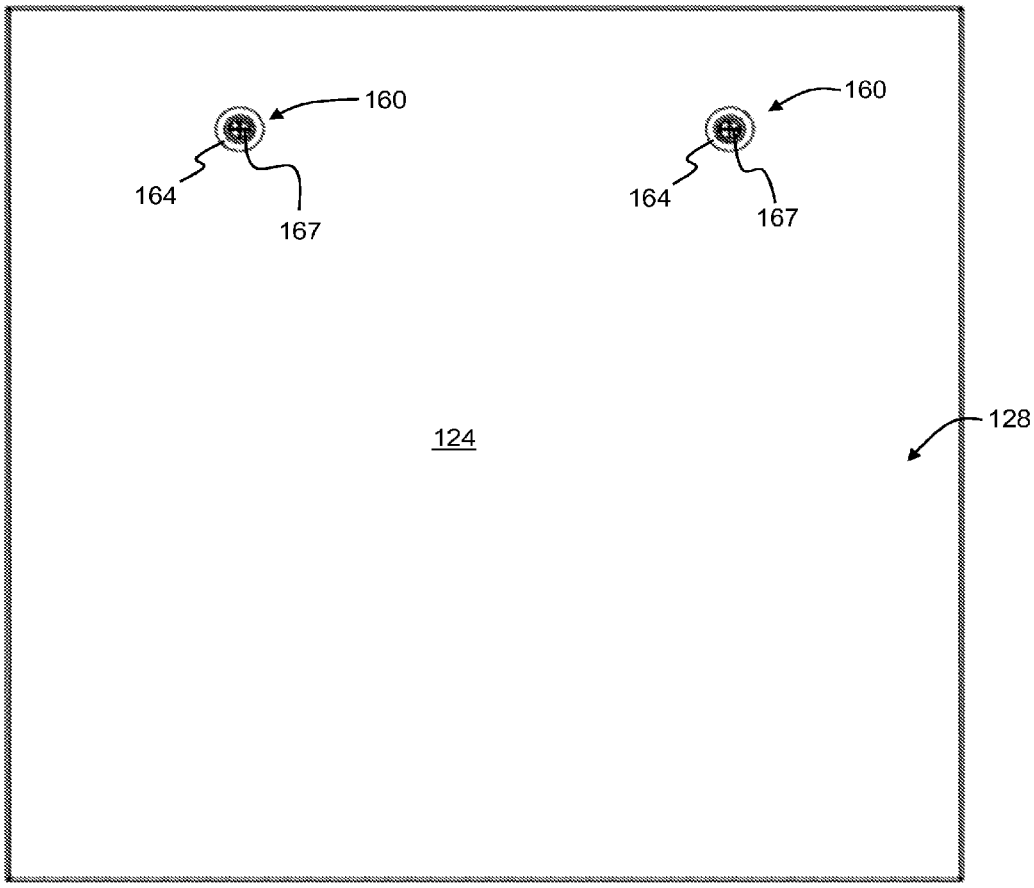
FIG. 9 is another plan view of the frameless access panel of FIG. 6, showing an outer side.

The following is directed to a frameless access panel that is generally non-combustible. The frameless access panel may be used for covering an aperture in a surface such as, for example, an opening in a wall, a ceiling or a floor.

As will be appreciated, the non-combustible feature of the frameless access panel advantageously allows the panel to be used in buildings located within jurisdictions in which existing or future building codes require building materials to be generally non-combustible. For example, Section 9.10.17.1 of the 2005 National Building Code of Canada requires that room lining materials used in residential construction have a Flame Spread Rating (FSR) value that does not exceed 150. Similarly, Sections 3.1.12 and 3.1.13 of the 2006 Ontario Building Code require that the interior wall finishes and interior ceiling finishes have an FSR value that does not exceed 75 for non-sprinklered buildings, or 150 for sprinklered buildings. Building codes having generally similar flame spread requirements are also currently in force in other jurisdictions, including the United States.

As is known in the art, FSR is generally related to the propensity of a material to burn rapidly and to spread flames. As will be understood, materials considered to be non-combustible such as, for example, metals and metal sheet of the kinds used in building structures, typically have a much lower FSR value as compared to other materials, such as wood and plastics. For this reason, metal and metal sheet are referred to herein as being "generally non-combustible", while wood and plastics are considered to be "generally combustible".

Turning now to FIGS. 1 to 5, a frameless access panel is shown and is generally indicated using reference numeral 20. Access panel 20 is configured to serve as a removable cover for an opening in a structural surface. In this embodiment, the access panel 20 serves as a removable cover for an opening in a wall fabricated of drywall paneling. Access panel 20 comprises a panel member 24, and in the embodiment shown, panel member 24 is generally square in shape. Panel member 24 has an inner surface 26 and an outer surface 28. Panel member 24 is bounded by a perimeter having a first edge 32 and a second edge 34, with the second edge 34 being opposite the first edge 32. In this embodiment, the panel member 24 is fabricated from metal sheet, and namely galvannealed steel sheet which is known by the trade name Satincoat™ or Satin Coat™.

The access panel 20 also comprises a mounting member 40 fastened to the inner surface 26 of the panel member 24. In this embodiment, mounting member 40 is fastened to the panel member 24 by spot welds. Mounting member 40 has a first end 42 generally proximate first edge 32 of panel member 24 and a second end 43 further spaced from first edge 32 than first end 42. Mounting member comprises two fixed tabs 44 and 46 extending outwardly from the first end 42 of the mounting member 40. Each of the fixed tabs 44 and 46 has a respective gripping surface 44*a* and 46*a* for gripping a side of the opening in the wall during use. In the embodiment shown, fixed tabs 44 and 46 are angled such that gripping surfaces 44*a* and 46*a* each form an acute angle with the inner surface 26 of the panel member 24. In this embodiment, the mounting member 40, including fixed tabs 44 and 46, is fabricated from metal sheet, and namely galvannealed steel sheet which is known by the trade name Satincoat™ or Satin Coat™.

The access panel 20 also has a cam latch member 60 that is mounted within a bore 62 (not shown) passing through the panel member 24 and which is generally proximate the second edge 34 of panel member 24. Cam latch member 60 comprises a disc-shaped base 64 that has an elongated spindle 66 extending therefrom in a direction away from the inner surface 26 of the panel member 24. Base 64 is sized so as to cover bore 62, and further comprises a slot 67 for receiving a tool for operating cam latch member 60, such as for example a screwdriver. In this embodiment, the elongated spindle 66 is integral with the disc-shaped base 64. Cam latch member 60 further comprises a disc-shaped clamp member 68 that is configured to abut against the inner surface 26 of the panel member 24, for cooperating with the base to generally retain the cam latch member 60 within bore 62. The cam latch member 60 also comprises a cam latch 70 attached to the spindle 66, and which extends outwardly therefrom and generally parallel to the panel member 24. In this embodiment, cam latch 70 comprises a gripping portion 72 configured for gripping the drywall paneling adjacent the opening in the wall, and also comprises an fastening portion 74 configured to be adjustably fastened to the spindle. As will be appreciated, the ability of the fastening portion 72 to be adjustably fastened along the length of the spindle 66 allows the gripping portion 72 to be positioned along the spindle 66 at a desired spacing, so as to accommodate drywall paneling of different thicknesses. In the embodiment shown, the fastening portion 74 of cam latch 70 is adjustably fastened to the spindle 66 using a screw 76. In this embodiment, the cam latch member 60, comprising base 64, spindle 66, clamp member 68, cam latch 70 and screw 76, is fabricated from metal, and namely steel.

Cam latch member 60 is configured to rotate within bore 62. Accordingly, the cam latch 70 is configured to rotate around an axis generally defined by spindle 66 between a first position and a second position. Here, the first position is generally proximate, but spaced from, the second edge 34 of panel member 24, while the second position is generally distal from, and therefore spaced further from, the second edge 34 of panel member 24.

In this embodiment, as all components of access panel 20 are fabricated from metal sheet or metal, access panel 20 is also able to retain its structural integrity at relatively high temperatures. For example, most steels have a melting point of about 1050° C. or higher. In comparison, the melting points of polymers commonly used for structural and building applications are much lower than that of steel. For example, the melting point of polystyrene (PS) generally ranges from about 240° C. to about 270° C.; the melting point of polyvinyl chloride (PVC) generally ranges from about 100° C. to about 260° C.; and the melting point of polypropylene (PP) generally ranges from about 130° C. to about 170° C. As will be appreciated, by fabricating all of the components from steel, the access panel 20 advantageously has a generally high temperature resistance as compared to frameless access panels fabricated from materials having lower melting points.

In use, access panel 20 may be installed into an opening 90 of a wall 92 by orienting the access panel 20 such that inner surface 26 faces the wall 92. The first edge 32 of the panel member 24 of the access panel 20 may then be brought towards an edge of the opening 90 such that the fixed tabs 44 and 46 engage any of a side or an inside of the opening 90. With the cam latch 70 in the second position, the second edge 34 of the panel member 24 may then be pivoted towards an edge of the opening 90 such that the cam latch 70 clears the side of the opening 90, so as to bring the perimeter of the panel member 24 into contact with the surface of the wall 92. Once in this position, the cam latch member 60 may be rotated using suitable tool, such as a screwdriver, so as to rotate the cam latch 70 from the second position to the first position, and such that the gripping portion 72 engages an inner surface of the drywall paneling adjacent the opening 90. Once the fixed tabs 44 and 46 and the gripping portion engage of the opening 90, the access panel 20 is in an installed position, illustrated in FIG. 5.

The access panel 20 may be removed from the installed position in generally a reverse sequence as that used for installation. Here, cam latch member 60 may be rotated so as to rotate the cam latch 70 from the first position to the second position. The second edge 34 of the panel member 24 may then be pivoted away from the wall 92 such that the cam latch 70 in the second position clears the side of the opening 90. The second edge 34 of the panel member 24 may then be pulled generally away from the wall 92, so as to remove the access panel 20 from the opening 90.

FIGS. 6 to 11 show another embodiment of a frameless access panel, and which is generally indicated using reference numeral 120. Access panel 120 is configured to serve as a removable cover for an opening in a structural surface and, in this embodiment, the access panel 120 serves as a removable cover for an opening in a wall fabricated of drywall paneling. Access panel 120 is generally similar to access panel 20 described above and with reference to FIGS. 1 to 5, however access panel 120 comprises two cam latch members. As the total retaining force provided by the two cam latches greater than the force provided by the single cam latch of access panel 20, access panel 120 may advantageously be of greater size or greater weight, or both, as compared to access panel 20. Accordingly, and as will be appreciated by those of skill in the art, the number cam latch members used in the frameless access panel may be varied, depending on any of the weight and the size of the access panel.

Access panel 120 comprises a panel member 124, and in the embodiment shown, panel member 124 is generally square in shape. Panel member 124 has an inner surface 126 and an outer surface 128. Panel member 124 is bounded by a perimeter having a first edge 132 and a second edge 134, with the second edge 134 being opposite the first edge 132. In this embodiment, the panel member 124 is fabricated from metal sheet, and namely galvannealed steel sheet which is known by the trade name Satincoat™ or Satin Coat™.

The access panel 120 also comprises a mounting member 140 fastened to the inner surface 126 of the panel member 124. In this embodiment, mounting member 140 is fastened to the panel member 124 by spot welds. Mounting member 140 has a first end 142 generally proximate first edge 132 of panel member 124 and a second end 143 further spaced from first edge 132 than first end 142. Mounting member comprises three fixed tabs 144, 146 and 148 extending outwardly from the second end 143 of the mounting member 140. Each of the fixed tabs 144, 146 and 148 has a respective gripping surface 144*a*, 146*a* and 148*a* for gripping a side of the opening in the wall during use. In the embodiment shown, fixed tabs 144 to 148 are angled such that gripping surfaces 144*a* to 148*a* each form an acute angle with the inner surface 126 of the panel member 124. In this embodiment, the mounting member 140, including fixed tabs 144 to 148, is fabricated from metal sheet, and namely galvannealed steel sheet which is known by the trade name Satincoat™ or Satin Coat™.

The access panel 120 also comprises two cam latch members 160 that are each mounted within a respective bore 162 passing through the panel member 124 and which are generally proximate the second edge 134 of panel member 124. Each cam latch member 160 comprises a disc-shaped base 164 that has an elongated spindle 166 extending therefrom in a direction away from the inner surface 126 of the panel member 124. Each base 164 is sized so as to cover the bore 162, and further comprises a slot 167 for receiving a tool for operating cam latch member 160, such as, for example, a screwdriver. In this embodiment, the elongated spindle 166 is integral with the disc-shaped base 164. Cam latch member 160 further comprises a disc-shaped clamp member 168 that is configured to abut against the inner surface 126 of the panel member 124, for cooperating with the base to generally retain the cam latch member 160 within bore 162. Each cam latch member 160 also comprises a cam latch 170 attached to the spindle 166, and which extends outwardly therefrom and generally parallel to the panel member 124. In this embodiment, cam latch 170 comprises a gripping portion 172 configured for gripping the drywall paneling adjacent the opening in the wall, and also comprises an fastening portion 174 configured to be adjustably fastened to the spindle. As will be appreciated, the ability of the fastening portion 172 to be adjustably fastened along the length of the spindle 166 allows the gripping portion 172 to be positioned along the spindle 166 at a desired spacing, so as to accommodate drywall paneling of different thicknesses. In the embodiment shown, the fastening portion 174 of cam latch 170 is adjustably fastened to the spindle 166 using a screw 176. In this embodiment, the cam latch member 160, comprising the base 164, the spindle 166, the clamp member 168, the cam latch 170 and the screw 176, is fabricated from metal, and namely steel.

Each cam latch member 160 is configured to rotate within its respective bore 162. Accordingly, the cam latch 170 is configured to rotate around an axis generally defined by spindle 166 between a first position and a second position. Here, the first position is generally proximate, but spaced from, the second edge 134 of panel member 124, while the second position is generally distal from, and therefore spaced further from, the second edge 134 of panel member 124.

Figure 10:
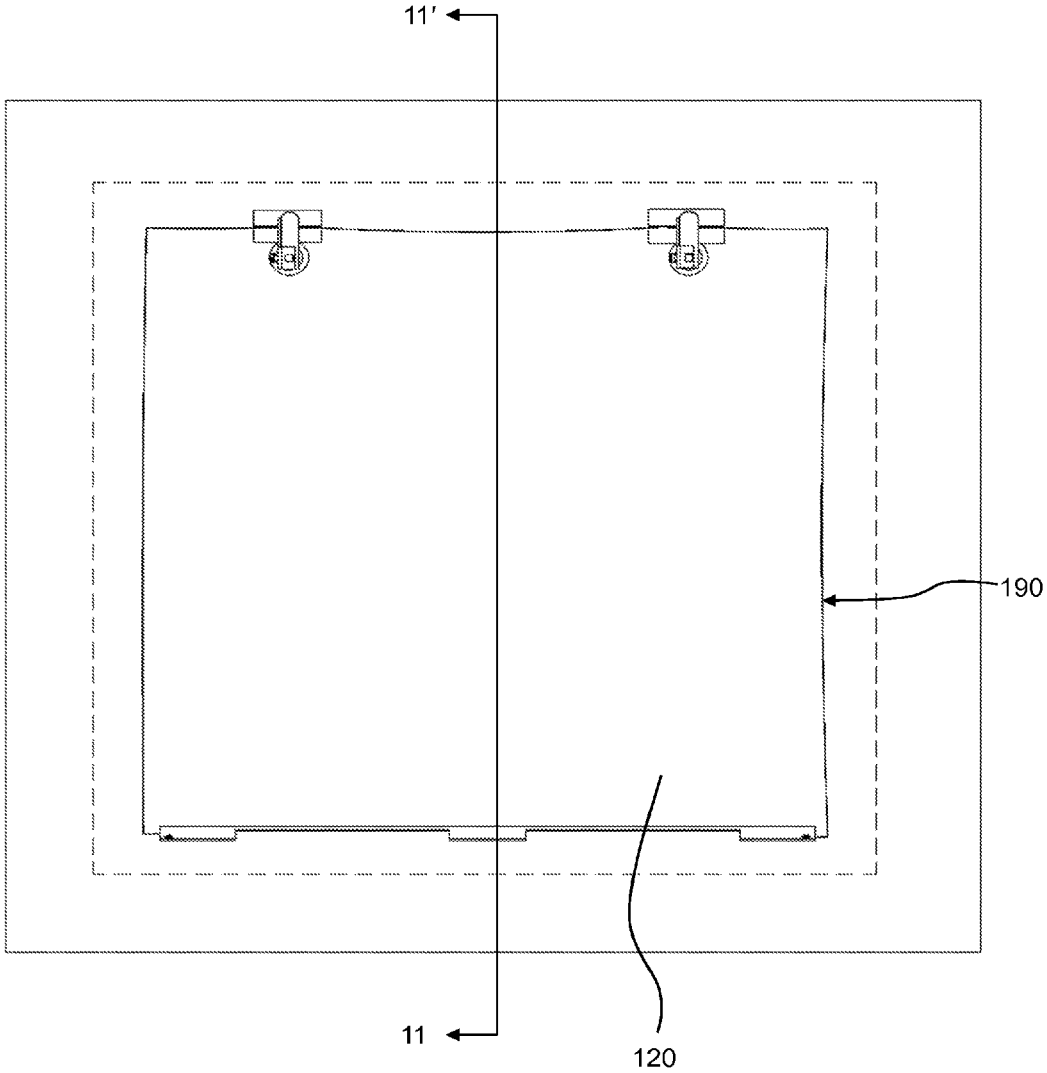
FIG. 10 is a view of the frameless access panel of FIG. 6 installed into a wall opening during use.
Figure 11:
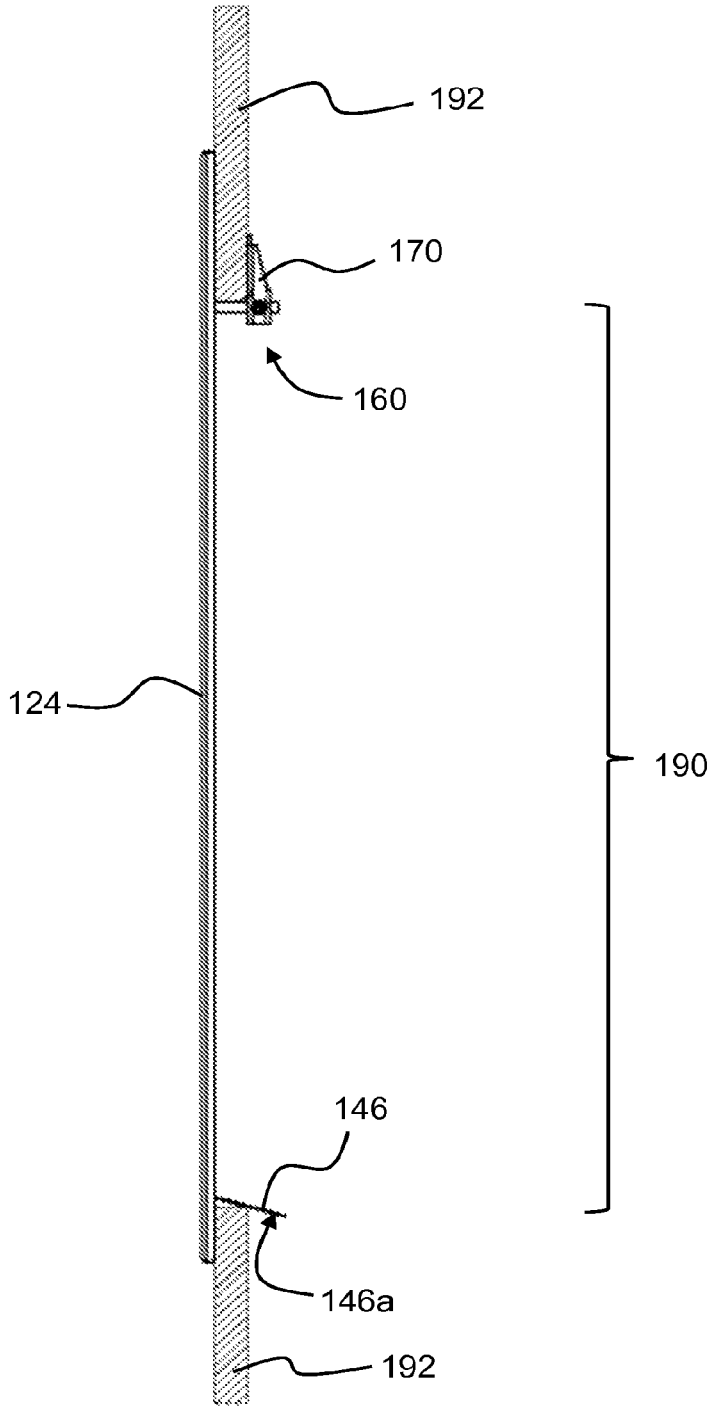
FIG. 11 is a side cross-sectional view of the frameless access panel of FIG. 6 installed into the wall opening of FIG. 10, taken along the indicated section line.
Figure 12:
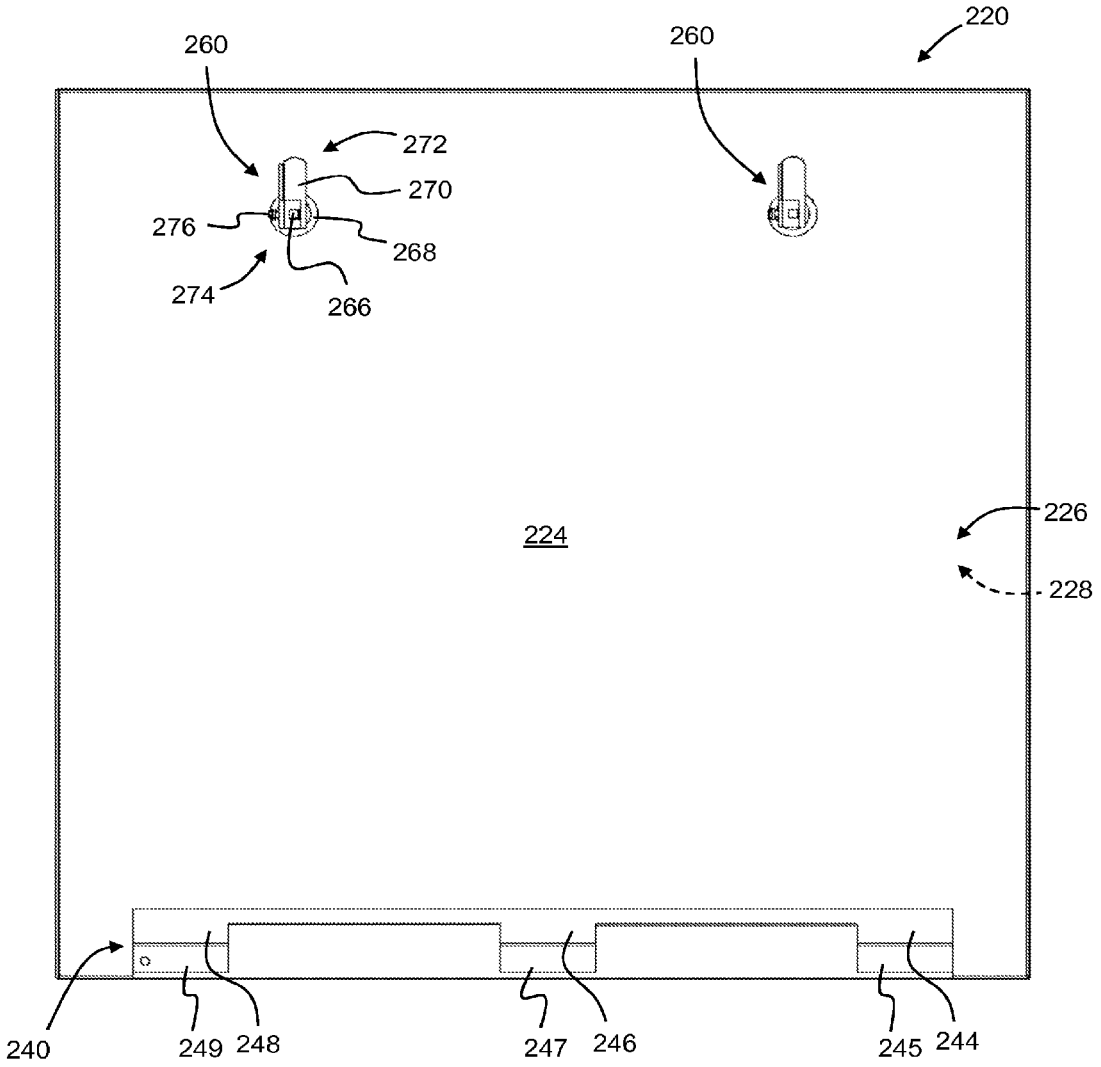
FIG. 12 is a plan view of another embodiment of a frameless access panel.
Figure 13:
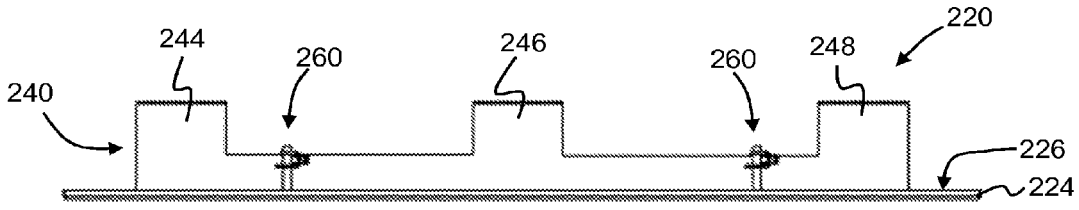
FIG. 13 is a front elevation view of the frameless access panel of FIG. 12.
Figure 14:
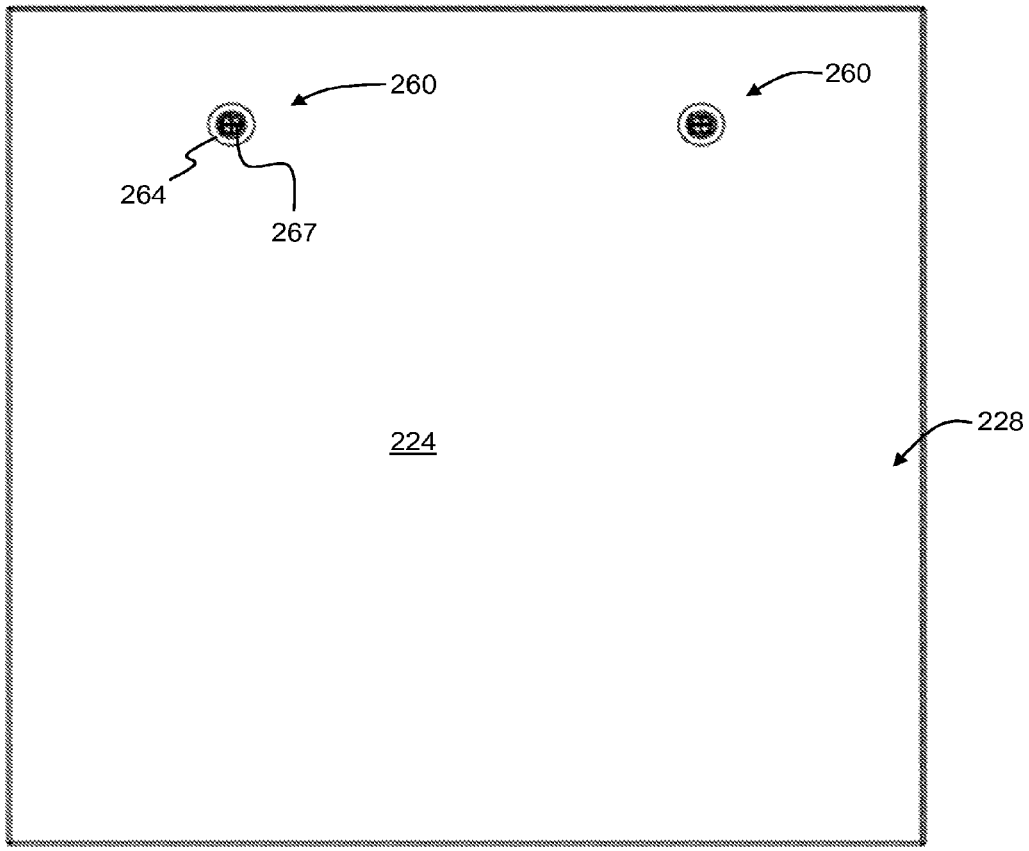
FIG. 14 is another plan view of the frameless access panel of FIG. 6, showing an outer side.
Figure 15:
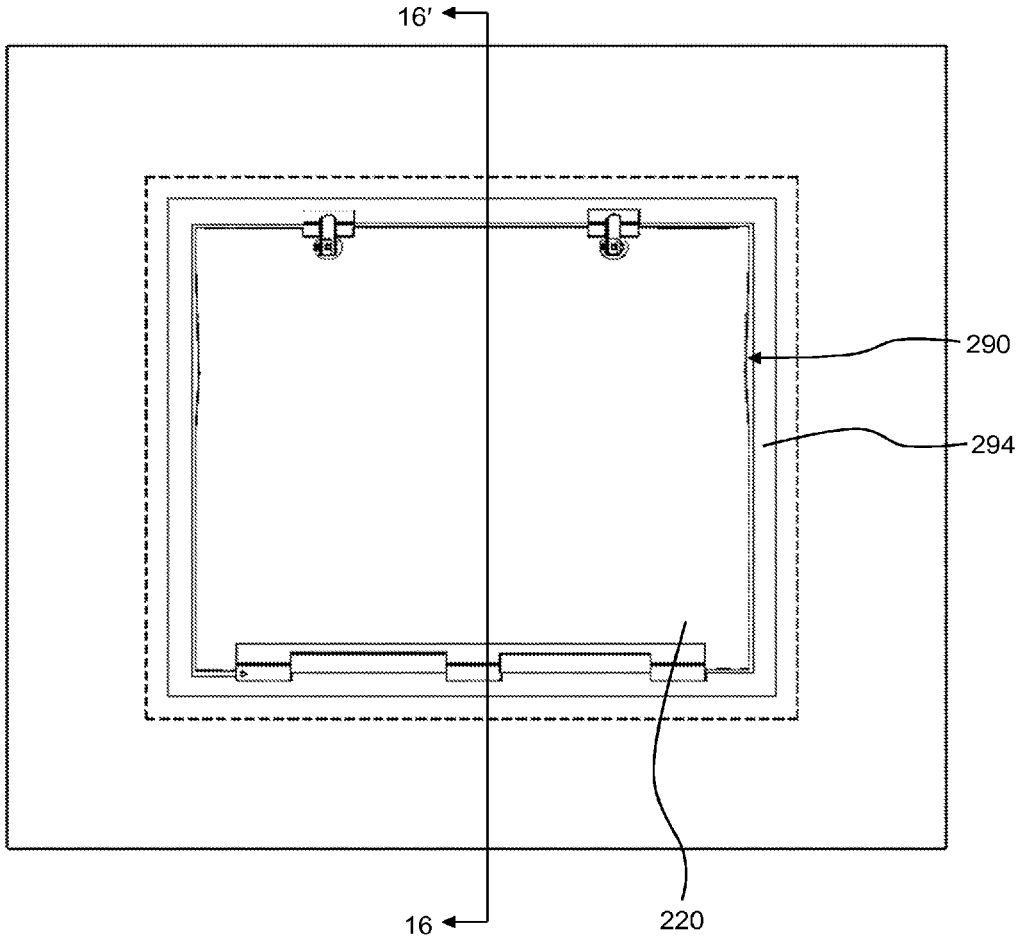
FIG. 15 is a view of the frameless access panel of FIG. 12 installed into a ceiling opening during use.
Figure 16:
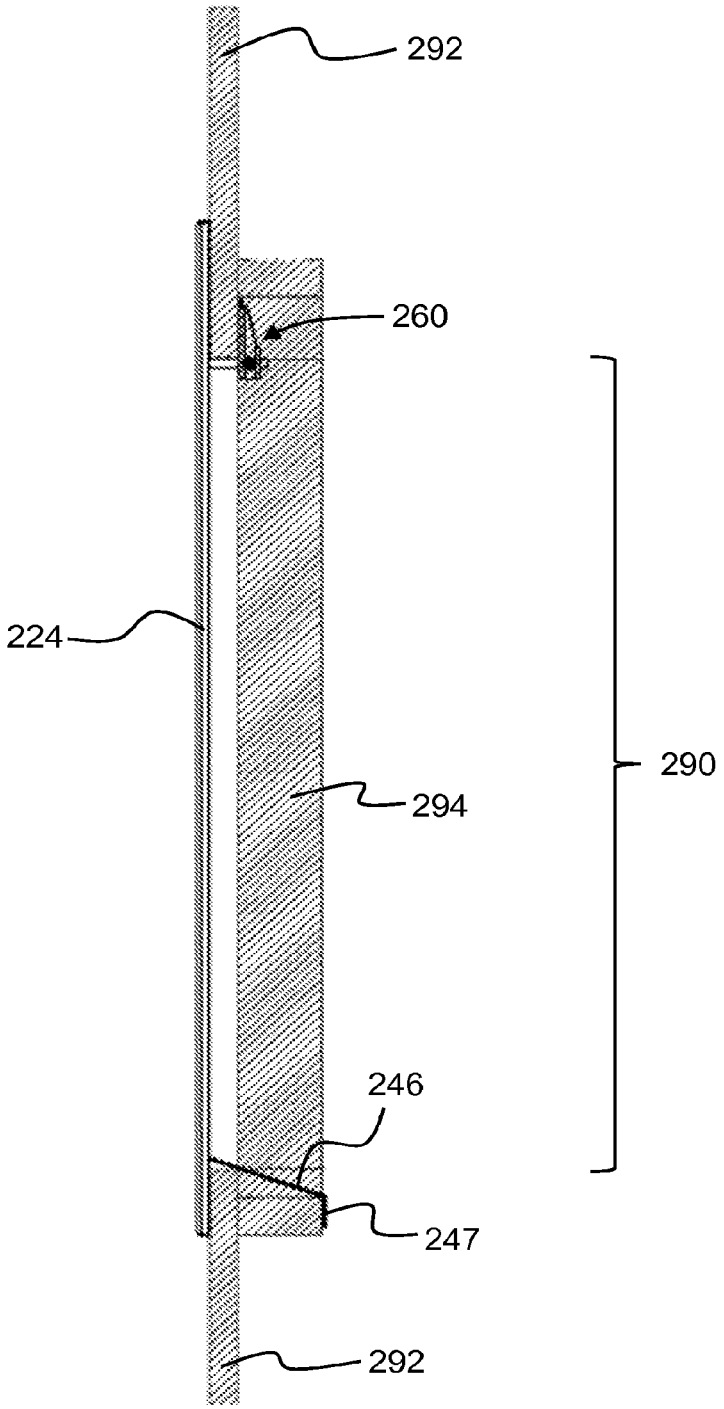
FIG. 16 is a side cross-sectional view of the frameless access panel of FIG. 12 installed into the wall opening of FIG. 15, taken along the indicated section line.

In use, access panel 120 may be installed into an opening 190 of a wall 192 in a manner that is generally similar as that described above for access panel 20, but wherein one or both cam latch members 160 is be rotated using suitable tool, such as a screwdriver, so as to rotate the one or more cam latches 170 from the second position to the first position, so as to bring the access panel 120 into an installed position, illustrated in FIGS. 10 and 11. The access panel 120 may be removed from the installed position by pulling the access panel 120 in a direction generally away from the wall 192, in a manner that is generally similar as that described above for access panel 20, but which involves rotating the one or more cam latch members 160 so as to rotate the one or more cam latches 70 from the first position to the second position.

FIGS. 12 to 16 show another embodiment of a frameless access panel, and which is generally indicated using reference numeral 220. Access panel 220 is configured to serve as a removable cover for an opening in a structural surface and, in this embodiment, the access panel 220 serves as a removable cover for an opening in a ceiling. Access panel 220 is generally similar to access panel 120 described above and with reference to FIGS. 6 to 11, and comprises a panel member 224 which, in the embodiment shown, is generally square in shape. Panel member 224 has an inner surface 226 and an outer surface 228. Panel member 224 is bounded by a perimeter having a first edge 232 and a second edge 234, with the second edge 234 being opposite the first edge 232. In this embodiment, the panel member 224 is fabricated from metal sheet, and namely galvannealed steel sheet which is known by the trade name Satincoat™ or Satin Coat™.

The access panel 220 also comprises a mounting member 140 fastened to the inner surface 226 of the panel member 224. In this embodiment, mounting member 240 is fastened to the panel member 224 by spot welds. Mounting member 240 has a first end 242 generally proximate first edge 232 of panel member 224 and a second end 243 further spaced from first edge 232 than first end 242. Mounting member comprises three fixed tabs 244, 246 and 248 extending outwardly from the second end 243 of the mounting member 240. Each of the tabs has a respective flange 245, 247 and 249 extending from one end thereof. Flanges 245, 247 and 249 are spaced from the panel member 224 so as to accommodate a thickness of a hatch frame surrounding the opening in the ceiling. Each of the fixed tabs 244, 246 and 248 has a respective gripping surface 244*a*, 246*a* and 248*a* for gripping a side of the opening in the ceiling and/or the side of the hatch frame during use. Similarly, each of the flanges 245, 247 and 249 has a respective gripping surface 244*a*, 246*a* and 248*a* for gripping the hatch frame during use. In the embodiment shown, fixed tabs 244 to 248 are angled such that gripping surfaces 244*a* to 248*a* each form an acute angle with the inner surface 226 of the panel member 224. Flanges 245 to 249 are angled such that gripping surfaces 245*a* to 249*a* are generally parallel with the inner surface 226 of the panel member 224. In this embodiment, the mounting member 240, including fixed tabs 244 to 248 and flanges 245 to 249, is fabricated from metal sheet, and namely galvannealed steel sheet which is known by the trade name Satincoat™ or Satin Coat™.

The access panel 220 also comprises two cam latch members 260 that are each mounted within a respective bore 262 passing through the panel member 224 and which are generally proximate the second edge 234 of panel member 224. Each cam latch member 260 comprises a disc-shaped base 264 that has an elongated spindle 266 extending therefrom in a direction away from the inner surface 226 of the panel member 224. Each base 264 is sized so as to cover the bore 262, and further comprises a slot 267 for receiving a tool for operating cam latch member 260, such as, for example, a screwdriver. In this embodiment, the elongated spindle 266 is integral with the disc-shaped base 264. Cam latch member 260 further comprises a disc-shaped clamp member 268 that is configured to abut against the inner surface 226 of the panel member 224, for cooperating with the base to generally retain the cam latch member 260 within bore 262. Each cam latch member 260 also comprises a cam latch 270 attached to the spindle 266, and which extends outwardly therefrom and generally parallel to the panel member 224. In this embodiment, cam latch 270 comprises a gripping portion 272 configured for gripping the drywall paneling adjacent the opening in the wall, and also comprises an fastening portion 274 configured to be adjustably fastened to the spindle. As will be appreciated, the ability of the fastening portion 272 to be adjustably fastened along the length of the spindle 266 allows the gripping portion 272 to be positioned along the spindle 266 at a desired spacing, so as to accommodate drywall paneling of different thicknesses. In the embodiment shown, the fastening portion 274 of cam latch 270 is adjustably fastened to the spindle 266 using a screw 276. In this embodiment, the cam latch member 260, comprising the base 264, the spindle 266, the clamp member 268, the cam latch 270 and the screw 276, is fabricated from metal, and namely galvannealed steel.

Each cam latch member 260 is configured to rotate within its respective bore 262. Accordingly, the cam latch 270 is configured to rotate around an axis generally defined by spindle 266 between a first position and a second position. Here, the first position is generally proximate, but spaced from, the second edge 234 of panel member 224, while the second position is generally distal from, and therefore spaced further from, the second edge 234 of panel member 224.

In use, access panel 220 may be installed into an opening of a wall in a manner that is generally similar as that described above for access panel 120, but wherein the first edge 232 of the panel member 224 of the access panel 220 may be brought towards an edge of the opening 290 such that the fixed tabs 244 to 248 and flanges 245 to 249 engage the hatch frame, or engage both the hatch frame and a side of the opening 290 and the hatch frame, and wherein one or more cam latch members 260 are rotated such that the one or more gripping portions 272 each engage an inner surface of the drywall paneling adjacent the opening 290 in a respective notch within the hatch frame. The access panel 220 is be rotated using suitable tool, such as a screwdriver, so as to rotate the one or more cam latches 270 from the second position to the first position, so as to bring the access panel 220 into an installed position, illustrated in FIGS. 15 and 16. The access panel 220 may be removed from the installed position in a manner that is generally similar as that described above for access panel 120.

In embodiments, typical values of Flame Spread Rating (FSR) and Smoke Developed Classification (SDC) for the access panel, as defined by the Standard CAN/ULC-S102-10, *Standard Method of Test for Surface Burning Characteristics of Building Materials and Assemblies*, range from 0 to about 30. In further embodiments, typical values of FSR and SDC for the access panel range from about 10 to about 20. Similarly, in specific embodiments regarding the panel member, typical values of FSR and SDC range from 0 to about 30. In further embodiments, typical values of FSR and SDC for the panel member range from about 10 to about 20.

Although in embodiments described above, components of the frameless access panel are fabricated from metal sheet, wherein the metal sheet is galvannealed steel sheet, in other embodiments, components of the frameless access panel may alternatively be fabricated from any other metal or metal alloy sheet that is non-combustible such as, for example, non-galvannealed steel sheet, stainless steel sheet, and aluminum sheet.

Although in embodiments described above, the components of the frameless access panel are fabricated from metal sheet and metal, in other embodiments, the components of the frameless access panel may alternatively be fabricated from one or more other materials that are generally non-combustible.

Although in embodiments described above, all of the components of the frameless access panel are fabricated from materials that are generally non-combustible, in other embodiments, only some of the components of the access panel may alternatively be fabricated from materials that are generally non-combustible, provided the frameless access panel is generally non-combustible.

Although in embodiments described above, the panel member is generally square in shape, in other embodiments, the panel member may alternatively be any one of, for example, rectangular, circular and oval in shape. In still other embodiments, the panel member may alternatively be any shape.

Although in embodiments described above, the frameless access panel comprises a mounting member having two (2) or three (3) fixed tabs, in other embodiments, the mounting member may alternatively comprise any number of fixed tabs, including one (1), or four (4) or more fixed tabs. In still other embodiments, the access panel may alternatively comprise no mounting member, and may instead comprise only cam latch members.

Although in embodiments described above, the access panel comprises a single mounting member, in other embodiments, the access panel may alternatively comprise a plurality of mounting members.

Although in embodiments described above, the frameless access panel comprises one (1) or two (2) cam latch members, in other embodiments, the access panel may comprise any number of cam latch members, including three (3) or more.

Although in embodiments described above, the frameless access panel serves as a removable cover for an opening in a wall fabricated of drywall paneling, in other embodiments, the frameless access panel may alternatively serve as a removable cover for an opening in a wall fabricated of any material of suitable thickness. In a related embodiment, the suitable thickness may be from about ½" (0.5 inches) to about ⅝" (0.625 inches). In still other embodiments, the frameless access panel may alternatively serve as a removable cover for an opening in any structural surface.

Those of skill in the art will understand that a spindle of any suitable length may be used to allow the cam latch to engage wall paneling of different thicknesses.

Although in embodiments described above, the mounting member is fastened to the panel member by spot welds, in other embodiments, the mounting member may alternatively be fastened to the panel member in any manner known in the art, such as for example by using fasteners, such as any of, for example, screws, rivets and bolts.

Although in embodiments described above, the cam latch member comprises a base and a disc-shaped clamp member, which is configured to abut against the inner surface of the panel member, for cooperating with the base to generally retain the cam latch member within the bore, those of skill in the art will appreciate that other components and/or techniques may be used to generally retain the cam latch member within the bore.

Although in other embodiments, the base of the cam latch member comprises a slot for receiving a tool for operating cam latch member, such as for example a screwdriver, in other embodiments, the base of the cam latch member may be alternatively configured for operating the cam latch member. In other embodiments, the cam latch member may further comprise a lock operable by a key for locking and unlocking the cam latch member in any of the first position and the second position.

Although in the embodiments described above, the cam latch member is fabricated from steel, those of skill in the art will understand that the cam latch member may be fabricated from any suitable steel, such as, for example, and not being limited to, nickel-plated steel and zinc-plated steel. In other embodiments, the cam latch member may alternatively be fabricated from any suitable metal or metal alloy.

Although in embodiments described above, the access panel serves as a removable cover for an opening in a wall fabricated of drywall paneling, in other embodiments, the access panel may alternatively serve as a removable cover for an opening in a wall made of any material or in a ceiling made of any material.

The following example illustrates various features of the above-described apparatus.

Example 1

In this example, panel members 24 were subjected to surface burning characteristics tests conducted in accordance with the Standard CAN/ULC-S102-10, *Standard Method of Test for Surface Burning Characteristics of Building Materials and Assemblies*. Each panel member 24 measured 521 mm wide×521 mm long, and was fabricated from galvannealed steel sheet. Fourteen (14) panel members were laid end to end to achieve a required sample length.

A summary of test results is shown in Table 1.

TABLE 1

| Test Sample | Sample Description | Calculated Flame Spread Value (FSV) | Calculated Smoke Developed Value (SDV) |
|---|---|---|---|
| A | panel members | 14.3 | 13.8 |
| B | panel members | 16.8 | 15.7 |
| C | panel members | 14.3 | 19.1 |

Figure 17:
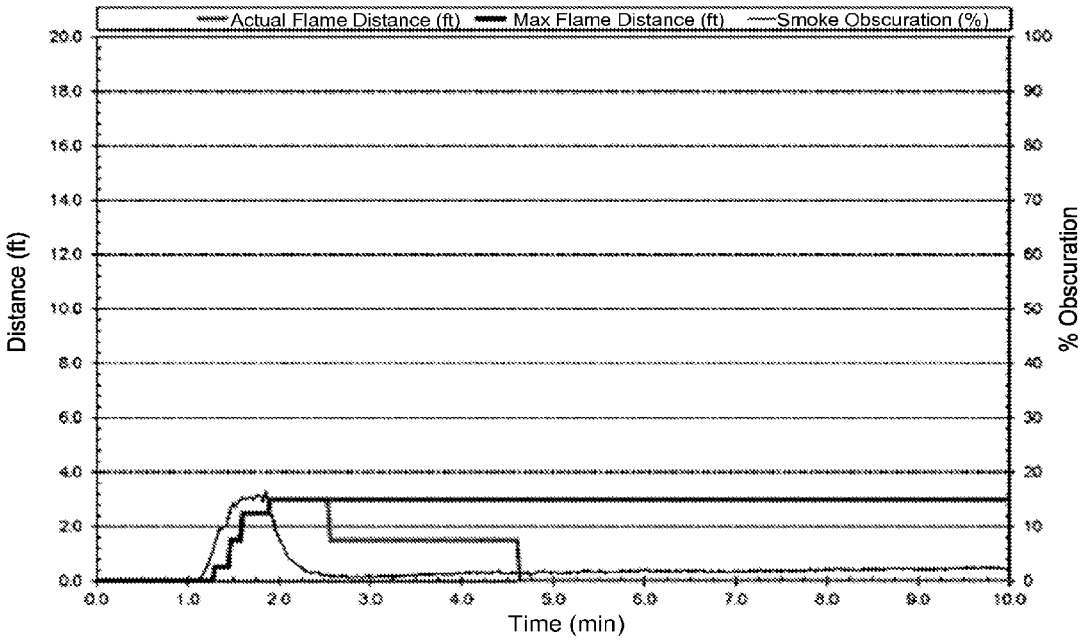
FIG. 17 is a graphical plot showing results of surface burning characteristics tests conducted on a first plurality of panel members, each panel member forming part of the access panel of FIG. 1.
Figure 18:
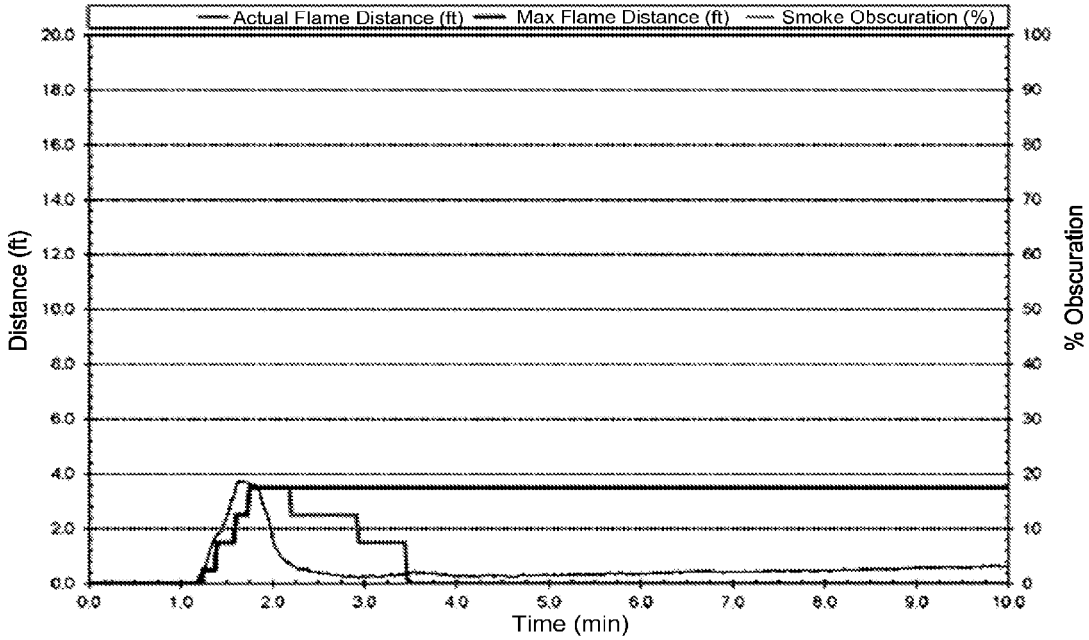
FIG. 18 is a graphical plot showing results of surface burning characteristics tests conducted on a second plurality of panel members, each panel member forming part of the access panel of FIG. 1.
Figure 19:
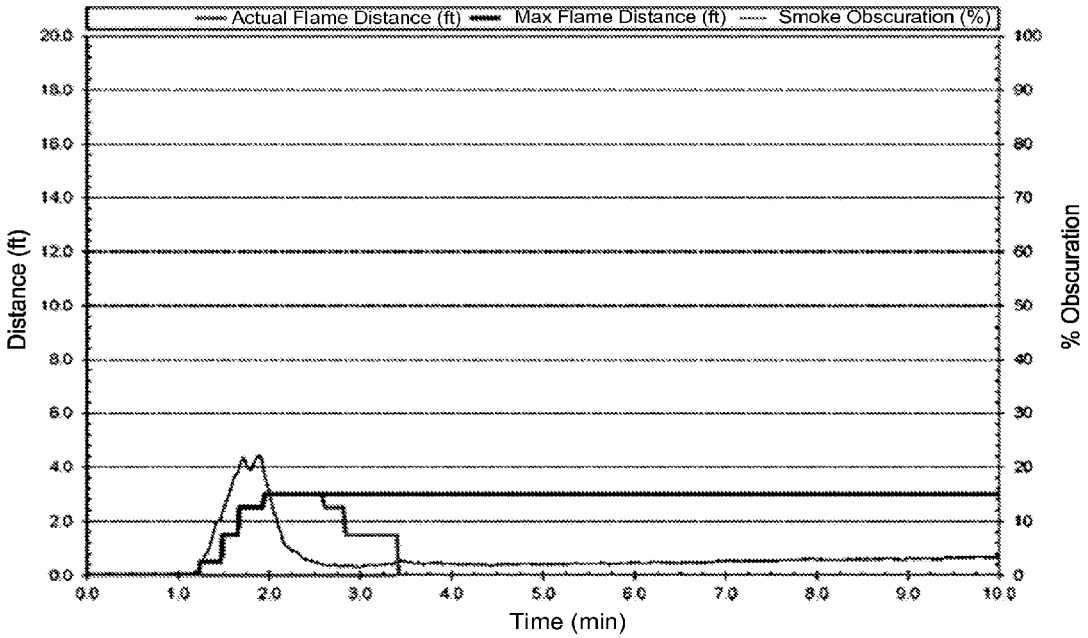
FIG. 19 is a graphical plot showing results of surface burning characteristics tests conducted on a third plurality of panel members, each panel member forming part of the access panel of FIG. 1.

Graphical plots showing the flame spread and light transmission of each of samples A, B and C are shown in FIGS. 17, 18 and 19, respectively.

The surface burning characteristics of Test Samples A to C warrants an assignment of a rating or classification shown in TABLE 2.

TABLE 2

| Material Details | Flame Spread Rating (FSR) | Smoke Developed Classification (SDC) |
|---|---|---|
| panel members | 15 | 15 |

For comparative purposes, the surface burning characteristics of various polymers subjected to surface burning characteristics tests conducted in accordance with the Standard CAN/ULC-S102-10 warrant an assignment of a rating or classification shown in TABLE 3. Therefore, these polymers are extremely combustible.

TABLE 3

| Material Details | Flame Spread Rating (FSR) | Smoke Developed Classification (SDC) |
|---|---|---|
| polystyrene (expanded foam board) | 200 | 500 |
| polypropylene copolymer (part for pipe support) | 155 | 500 |
| acrylic (cast sheet) | 100 | 435 |
| melamine (panel) | 135 | 305 |

Although embodiments have been described above with reference to the accompanying drawings, those of skill in the art will appreciate that variations and modifications may be made without departing from the spirit and scope thereof as defined by the appended claims.

What is claimed is:

1. A frameless access panel comprising:

a panel member having an inner surface and an outer surface;

a mounting member mounted to the inner surface and comprising at least one fixed tab extending outwardly from the inner surface at an angle, the fixed tab being spaced from a first edge of the panel member; and at least one cam latch member comprising a cam latch rotatable around an axis spaced from a second edge of the panel member, the second edge being opposite the first edge, the cam latch being rotatable between a first position and a second position, the second position being spaced further from the second edge than the first position;

the frameless access panel being generally non-combustible; and the frameless access panel being a removable frameless access panel, wherein the panel member is fabricated from a material having a melting point greater than 1050 degrees Celsius, wherein the Flame Spread Rating (FSR) of the access panel is from 0 to about 30, and wherein the Smoke Developed Classification (SDC) of the access panel is from 0 to about 30.

2. The frameless access panel according to claim 1, wherein the frameless access panel is fabricated of metal.

3. The frameless access panel according to claim 1, wherein any of the panel member and the mounting member are fabricated of sheet metal.

4. The frameless access panel according to claim 3, wherein the sheet metal comprises galvannealed steel sheet.

5. The frameless access panel according to claim 1, wherein the mounting member comprises a plurality of fixed tabs.

6. The frameless access panel according to claim 1, wherein the access panel comprises a single cam latch member.

7. The frameless access panel according to claim 1, wherein the access panel comprises two cam latch members.

8. The frameless access panel according to claim 1, wherein said at least one cam latch member comprises a plurality of cam latch members.

9. The frameless access panel according to claim 1, wherein the panel member is generally square in shape.

10. The frameless access panel according to claim 1, wherein the at least one fixed tab has a gripping surface, the angle formed by the gripping surface and the inner surface being an acute angle.

11. The frameless access panel according to claim 1, wherein the at least one fixed tab further comprises a flange extending from an end thereof.

12. The frameless access panel according to claim 11, wherein the flange is generally parallel with the panel member.

13. The frameless access panel according to claim 1, wherein the frameless access panel has a generally high temperature resistance.

14. The frameless access panel according to claim 1, wherein all components of the frameless access panel are fabricated from a material having a melting point greater than 1050 degrees Celsius.

15. The frameless access panel according to claim 1, wherein the Flame Spread Rating (FSR) of the access panel is from about 10 to about 20.

16. The frameless access panel according to claim 1, wherein the Smoke Developed Classification (SDC) of the access panel is from about 10 to about 20.

* * * * *